US008540398B2

(12) United States Patent
Harris

(10) Patent No.: US 8,540,398 B2
(45) Date of Patent: Sep. 24, 2013

(54) MULTIDIRECTIONAL LIGHT EMITTING FIXTURE

(76) Inventor: William F. Harris, Charlotte, NC (US)

( * ) Notice: Subject to any disclaimer, the term of this patent is extended or adjusted under 35 U.S.C. 154(b) by 730 days.

(21) Appl. No.: 12/689,937

(22) Filed: Jan. 19, 2010

(65) Prior Publication Data

US 2011/0175545 A1 Jul. 21, 2011

(51) Int. Cl.
*F21S 4/00* (2006.01)
*H05B 37/00* (2006.01)

(52) U.S. Cl.
USPC ..... 362/249.06; 362/249.14; 315/185 R

(58) Field of Classification Search
USPC ..... 315/84, 150–152, 185 R, 291, 307, 315/312; 362/127, 145, 217.1–217.17, 249.01, 362/249.02, 362, 364, 366, 432, 800, 249.06, 362/249.14
See application file for complete search history.

(56) References Cited

U.S. PATENT DOCUMENTS 6,980,119 B2 * 12/2005 Toulmin et al. ..... 340/815.45
7,690,659 B2 * 4/2010 Wilt ..... 280/87.042
2005/0207152 A1 * 9/2005 Maxik ..... 362/231

* cited by examiner

*Primary Examiner* — Jimmy Vu
(74) *Attorney, Agent, or Firm* — Alston & Bird LLP

(57) ABSTRACT

Lighting fixtures, apparatuses, methods, systems, computer readable media and other means are provided for a scalable light fixture design that allows a lighting manufacture to easily create custom multidirectional lighting fixtures. The approach may be easily modified and adjusted without departing from the general design and without incurring the otherwise larger redesigning costs often associated with the creation of light fixtures customized for a particular lighting design application.

17 Claims, 8 Drawing Sheets

100

100

300

300

MULTIDIRECTIONAL LIGHT EMITTING FIXTURE

TECHNOLOGICAL FIELD

Embodiments of the present disclosure relate generally to light emitting fixtures and, more particularly, a light fixture design that can be adjusted for various lighting applications to provide multidirectional, three-dimensional illumination.

BACKGROUND

Lighting fixtures are commonly used to support and power light emitting devices, which include various types of light bulbs and light emitting diodes (LEDs). The lighting fixtures and/or the light emitting devices sometimes have a lens or other transparent cover that diffuses the light in multiple directions or focuses the light to a particular area. For example, a parking lot or street lamp may include a diffusion lens that causes the light to scatter and uniformly illuminate a wide area, where as a flash light can have a lens that focuses the light in a given direction.

Some areas require a particular quantity of light, usually measured in lumens, for safety, aesthetic or other reasons. For example, a parking deck may need all areas of the parking deck illuminated by a minimum quantity of lumens. As another example, a home owner may want to light the entire perimeter of his house with a certain amount of lumens. Because light fixtures are often rounded, some areas, such as those in nooks and corners, may require installation of additional light fixtures to assure the minimum amount of lumens illuminate the entire area.

In other illumination applications, such as in airplane cargo bays or crawl spaces under homes, traditional hand held lights are less than optimal. Because traditional hand held lights most brightly illuminate the area closest to the fixture, the user of the hand held light generally needs to carefully position himself and the light, and sometimes use a stand to direct the light fixture or a hook to hang the light fixture in a manner that provides enough light to see, while enabling the user move around without blocking the light or blinding the user.

In addition, most lighting fixtures also include wires that supply the light emitting devices power from a battery, solar panel and/or main power line. Lighting fixtures intended primarily for outdoor use generally place the wires inside the lighting fixture to protect the wires and other electrical components (except, of course, the solar panels) from the rain, wind and other natural elements.

BRIEF SUMMARY

Embodiments of the present disclosure relate generally to light emitting fixtures and, more particularly, methods, systems, apparatuses, computer readable media and other means for providing a scalable design that can be efficiently modified to satisfy various lighting applications and provide multidirectional, three-dimensional illumination. The light fixture of some embodiments can comprise a hub and extended members.

Each of the extended members can be physically and electrically (in some embodiments) coupled to the hub. At least one of the extended members can be angled at a first degree along an axis at a first location. The first degree can be zero or any non-zero angle. The first location can be, for example, where the extended member joins the hub. Each extended member can join the hub at a different location on the hub.

Light emitting devices can be physically and/or electrically coupled to the hub and/or one or more of the extended members. The light emitting devices can comprise, for example, one or more light emitting diodes, incandescent light bulbs, fluorescent light bulbs, infrared light bulbs, ultraviolet light bulbs, any other type of light emitting device or component, or any combination thereof.

The angling of an extended member creates a concave face and a convex face of each extended member and the hub. The concave face of the extended member and the hub is the interior face (relative to the angling direction of the extended member(s) nearest the hub), while the convex face is the exterior face of the extended members and the hub (again, relative to the direction of the angling nearest the hub). The light emitting devices can be configured to shine in a direction generally outward from either the convex or concave face of an extended member and/or the hub. As such, the light fixture can point one or more light emitting devices in different directions, thereby providing multidirectional, three-dimensional illumination.

One or more of the extended members can be angled more than once, at the same or different degree(s) than the degree of angling nearest the hub. The additional location(s) of angling can be anywhere between the first location (nearest the hub) and the end of the extended member(s) (i.e., the portion of the extended member farthest from the hub).

The hub can take any shape. In some embodiments, the hub's shape can be related to the number of extended members. For example, the hub can be an octagon if the light fixture includes eight extended members, a hexagon if the light fixture includes six extended members, a pentagon if the light fixture includes five extended members, etc. The light fixture can include any number of extended members. Each of the extended members and/or the hub can have one, none or a plurality of the light emitting devices that are physically and electrically coupled thereto.

The light fixture can also comprise one or more mounting components. For example, a mounting component can be a flange at the end of one or more extended members. The mounting component can also comprise, for example, at least one hole. In some embodiments, the hub can comprise a mounting component. The mounting component can be configured to enable the light fixture to be, e.g., hung and/or mounted atop a pole among other things.

In some embodiments, the light fixture, or portions thereof (e.g., extended members and/or hub), can comprise a thermally conductive material. The thermally conductive material can assist in dissipating the heat generated by light emitting devices.

Similarly, embodiments of computer readable program products and methods are also discussed herein for providing multidirectional illumination. For example, power can be provided to light emitting devices that are physically and electrically coupled to extended members. In response to receiving power, light emitting devices can emit light. In some embodiments, the power can be varied to control the intensity of the illumination.

Some embodiments include positioning the extended members to direct the light emitted from the light emitting devices in different directions. As mentioned above, the positioning can comprise angling at least one of the extended members at a first location, wherein the first location is where the extended member joins the hub. The extended members can also be angled at one or more additional locations, wherein the additional location is between the first location and the end of the extended member. A light emitting device can be located anywhere on the light fixture, such as between where the extended member is angled.

In some embodiments, each extended member and/or the hub can comprise one or more sensors, including a sensor that detects the quantity of ambient light local to an extended member and/or hub. For example, the light fixture can be configured to adjust the power to control the brightness of light emitting devices physically coupled to the extended members in response to determining, for example, the quantity of ambient light local to an extended member is below a threshold.

Also discussed herein are embodiments that can be used to design and configure the electrical components of a light fixture. For example, a design system can be configured to receive inputs associated with a lighting application, and determine the degree and number of each angle that should be integrated into the light fixture to meet the application's illumination requirements. The design system can also be configured to determine the materials and/or optimal size (e.g., length, width and thickness) of the extended members and hub, as well as the quantity of extended members that should be included in the light fixture.

Some embodiments can include a light fixture configured to provide multidirectional illumination, comprising extended members that are configured to be mounted relative to a mounting surface. The mounting surface can include a hub or any other surface, real or imaginary that can define a reference plane, which can be parallel to the surface of the ground below or ceiling above. For example, each of the extended members can be operably (e.g., physically and/or electrically) coupled to at least one of the other extended members, and the extended members can then be positioned at one or more predefined, non-zero angles (which may be greater or less than zero degrees) relative to the mounting surface. The light fixture can also include light emitting devices, wherein at least one of the light emitting devices is physically and electrically coupled to one of the extended members. The light fixture can point at least two of the light emitting devices in different directions, and one or more of its extended members can include a flange configured for mounting the lighting device.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4:
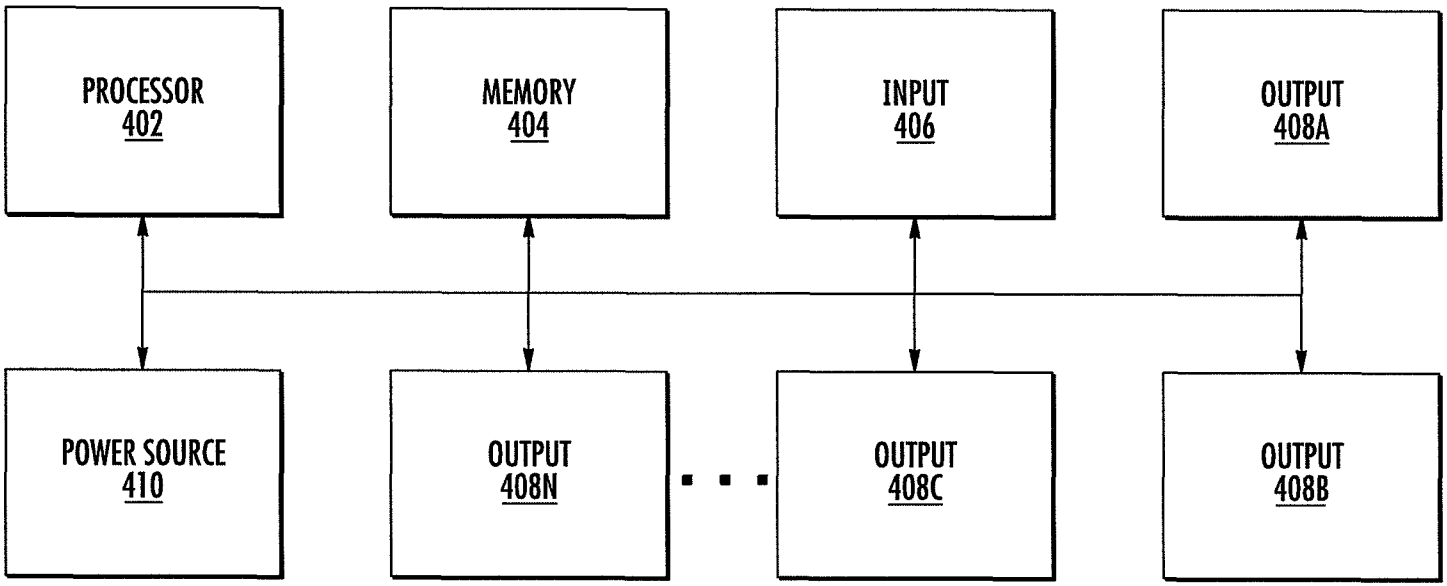
Figure 5A:
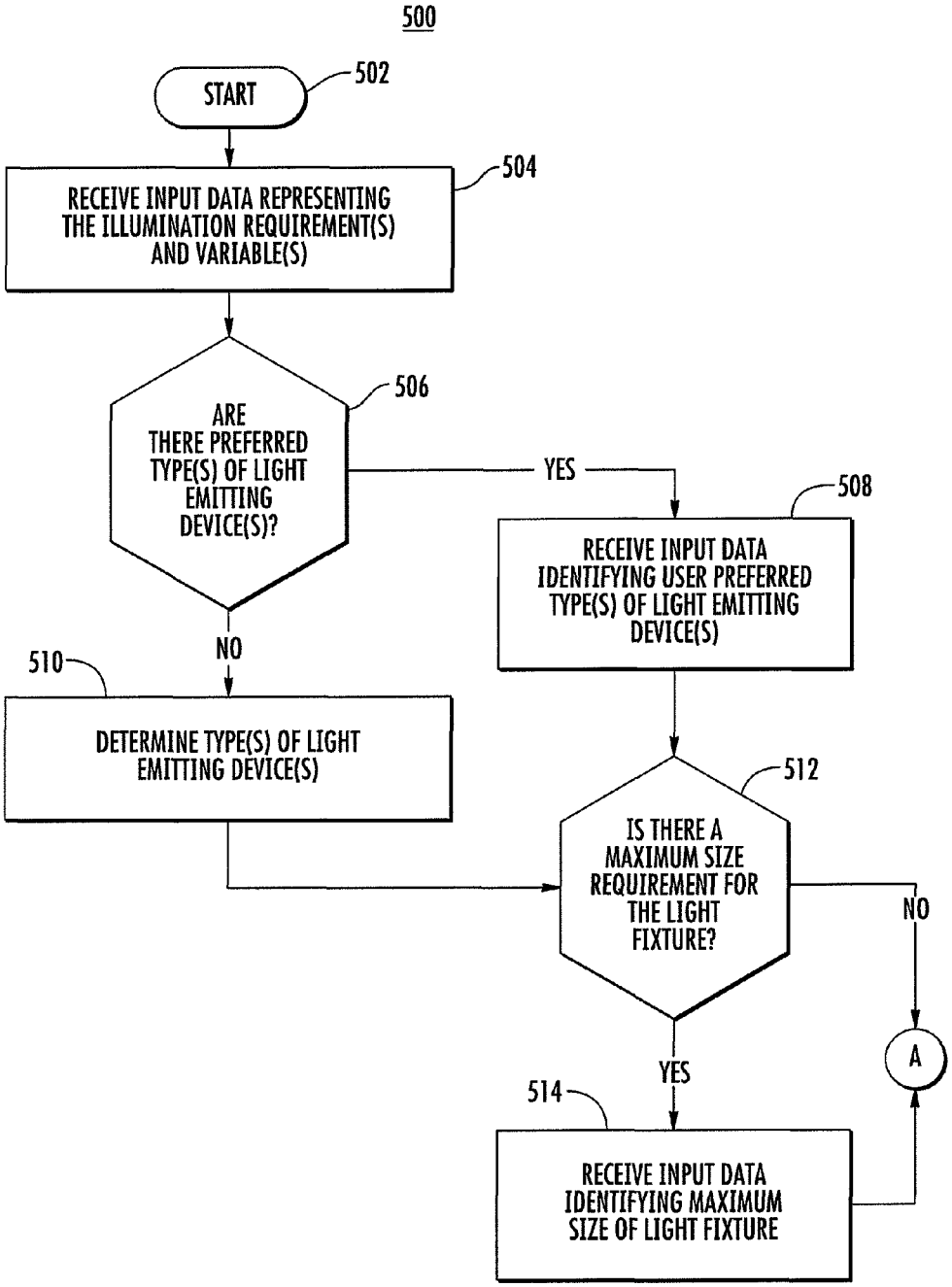
Figure 5B:
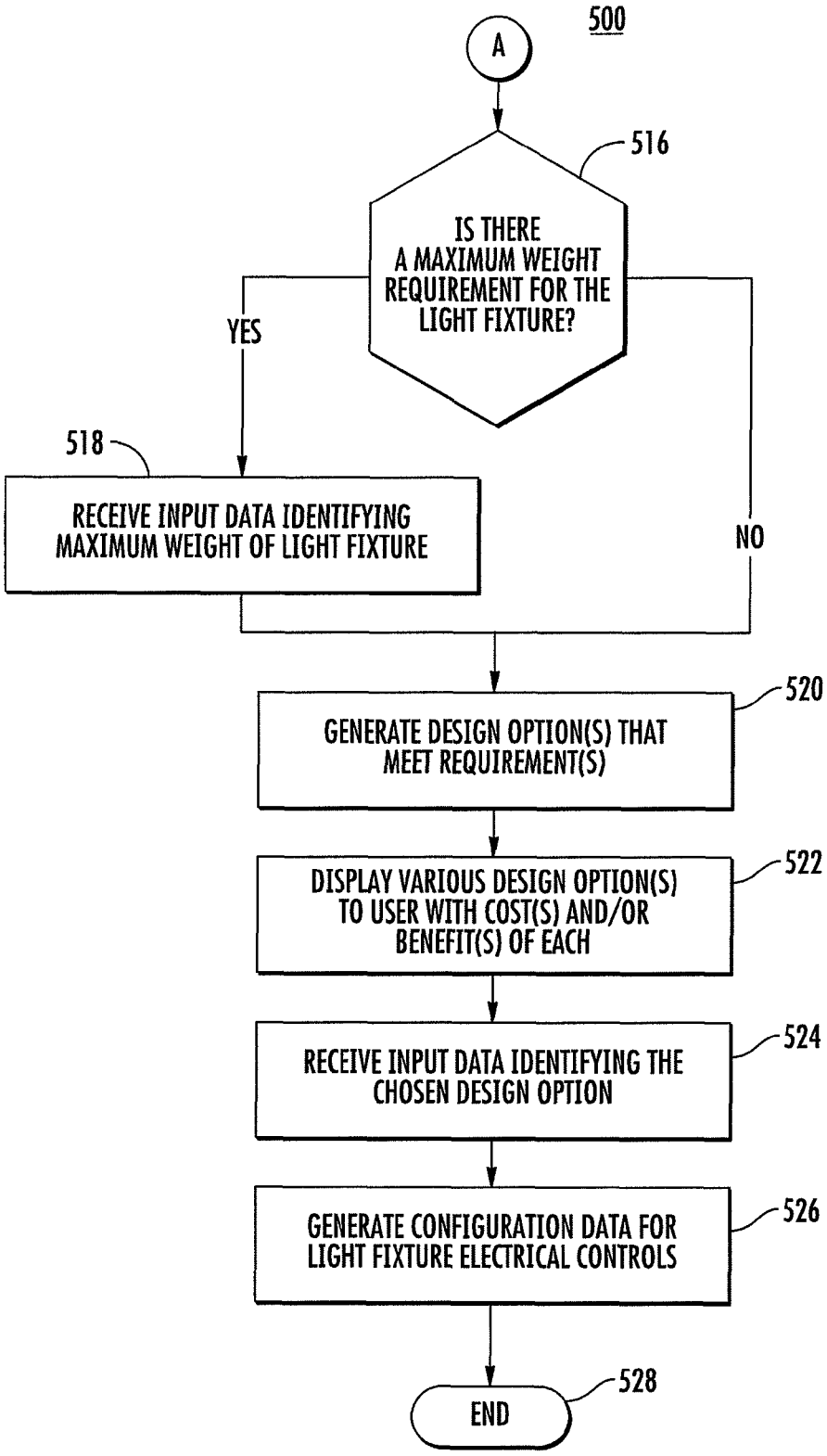

FIG. 4 shows an exemplary block diagram of circuitry and other electrical components of a light fixture in accordance with some embodiments; and FIGS. 5A and 5B show a process flow according to embodiments for designing and configuring both physical and electrical components of a light fixture that is customized satisfy a particular illumination application's requirements in accordance with some embodiments.

DETAILED DESCRIPTION

Embodiments of the present disclosure now will be described more fully hereinafter with reference to the accompanying drawings, in which some, but not all embodiments of the inventions are shown. Indeed, aspects of this disclosure may be embodied in many different forms and should not be construed as limited to the embodiments set forth herein; rather, these embodiments are provided so that this disclosure will satisfy applicable legal requirements. Like numbers refer to like elements throughout.

Discussed herein are embodiments of a lighting fixture having a plurality of physical components, including extended members, that converge at a hub. The hub and/or extended members can be configured to each support one or more light emitting devices. In some embodiments, the electrical components, which provide power to light emitting device(s), can also be configured to meet at the hub.

The size (e.g., length, width and/or thickness) of the extended members and hub can be scalable, i.e., adjusted to meet the particular lighting requirements of a particular application without departing from the general design. The general design discussed herein can allow a lighting manufacturer to, among other things, easily create custom multidirectional light fixtures that point light emitting devices in up to all three dimensions, without incurring the otherwise more substantial costs generally associated with custom designing light fixtures for a particular application. As used herein, a lighting "application" refers to any desired illumination requirements of a lighting fixture, which may be broken down into one or a combination of variables including, for example, illumination quantity requirement(s), installation environment(s) (e.g., exposed to natural elements, protected from the elements, or a combination thereof), installation location(s) (such as, e.g., particular area(s) of a parking deck, tunnel, stadium, airport hangar, aircraft cargo space, home exterior, etc.), timing of illumination (e.g., day, night, pulsed, random, etc.), intensity of illumination, color of illumination, any other illumination-related variable, and/or any combination thereof. In some embodiments each variable can be specific to each light emitting device, a group of light emitting devices (such as, e.g., all the lights on the hub, all the lights on an extended member, the lights on each extended member farthest from the hub, the lights on each extended member that are a particular distance from the hub, and/or any other combination of light emitting devices), or all the lights of the light fixture.

In addition, the scalable design can be used to avoid sacrificing the operational efficiency that occurs when implementing a plurality of standard light fixtures to meet the illumination needs of a specific application. For example, an application may require 30% or 50% more illumination than what a single standard light fixture can provide and, to meet the unique needs of the application, a second standard light fixture is often used; thereby sacrificing energy efficiency by unnecessarily doubling the lighting capacity. Despite the long term inefficiencies, adding extra light fixtures is often the chosen approach, because it does not incur the expenses associated with custom designing and manufacturing a new lighting fixture. The expense required to setup and tool manufacturing systems for a custom designed light fixture is often prohibitive and outweighs the benefits. However, some embodiments discussed herein, such as, e.g., those related to the scalable multidirectional light fixture, may avoid the prohibitive costs commonly associated with the setup and tooling of manufacturing systems for custom designed light fixtures.

The scalable multidirectional design of embodiments discussed herein can also avoid energy inefficiencies associated with the commonly implemented solutions used to provide multidirectional lighting. In particular, a scatter lens or other light diffusion apparatus is often used to direct light in multiple directions. Such apparatuses often cause energy to be wasted by scattering the light. The scalable designs discussed herein can be used to provide uniform multidirectional illumination or non-uniform multidirectional illumination while maximizing the energy efficiency of the lighting fixture for a particular application.

Figure 1A:
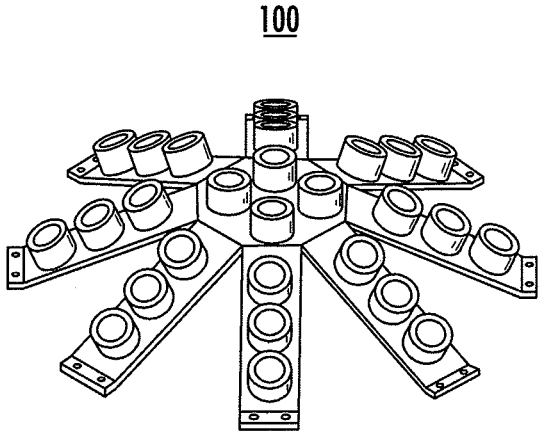
FIGS. 1A-1D show various exemplary views a light fixture in condition with some embodiments having light emitting devices on the convex faces of each extended member and the hub.
Figure 1B:
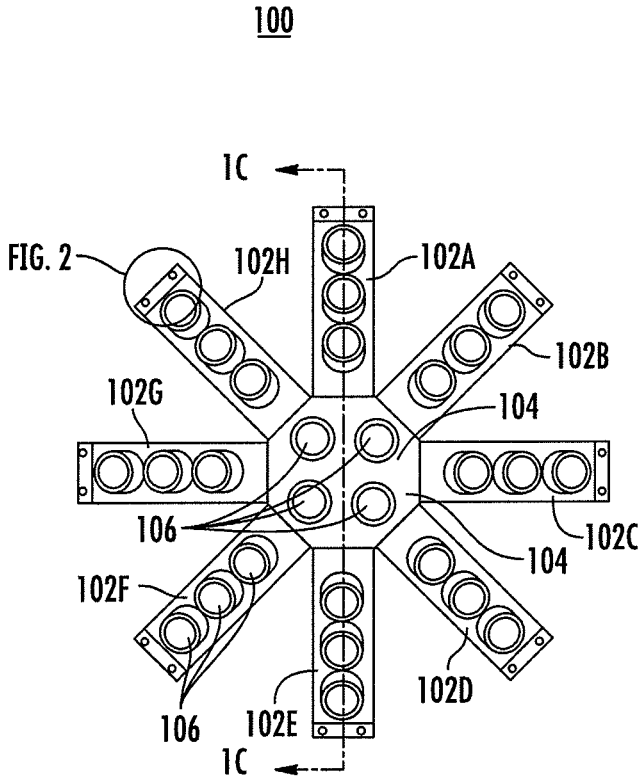
Figure 1C:
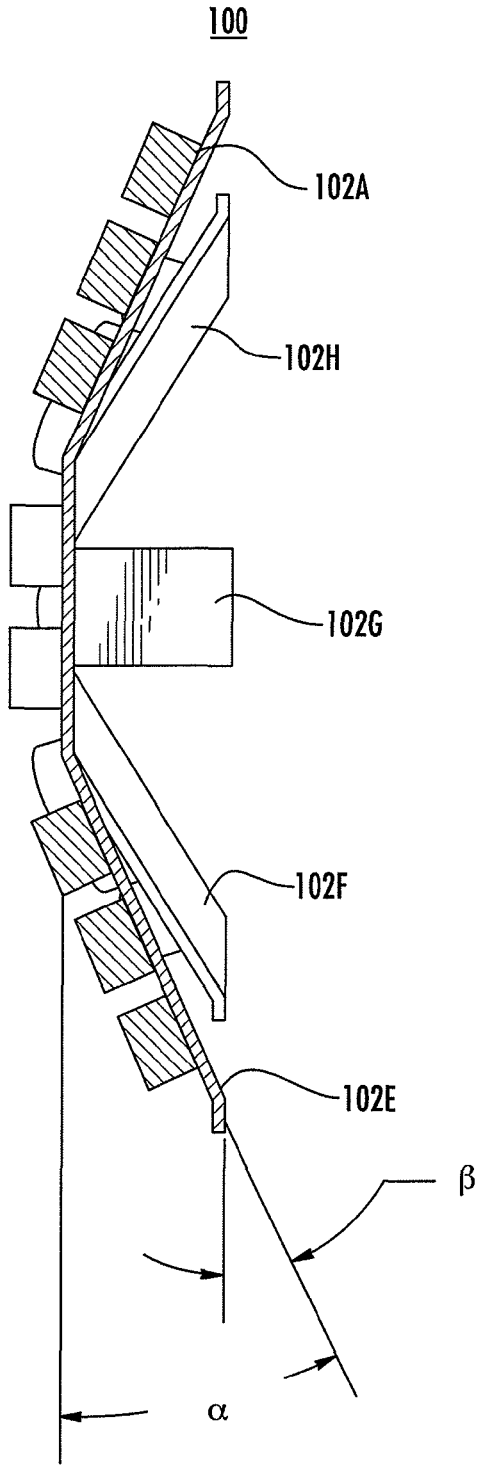
Figure 1D:
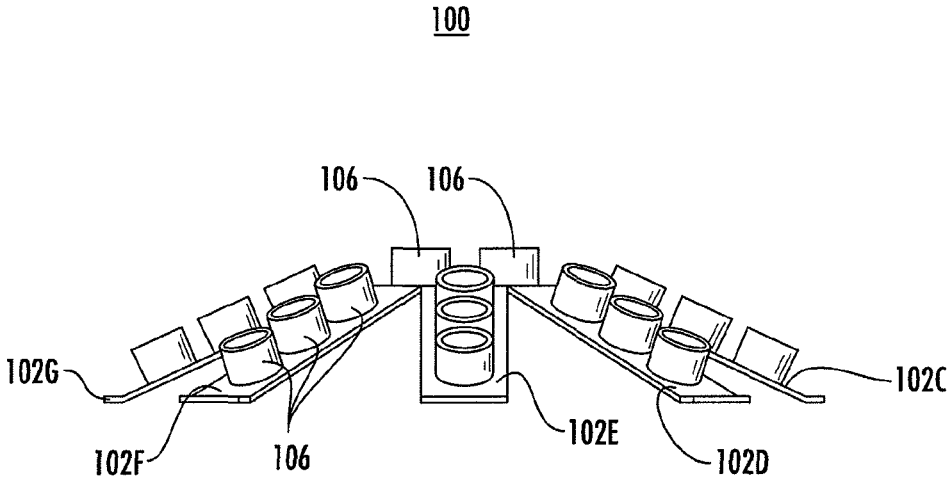

FIGS. 1A-1D show an exemplary light fixture 100 in accordance with some embodiments of the present invention. FIG. 1A shows an isometric view of the exemplary light fixture 100. FIG. 1B shows a view of the convex light fixture 100. FIGS. 1C and 1D respectively show a cut-away view and different side view of light fixture 100. Various aspects of light fixture 100 can be redesigned (as mentioned above and discussed in greater detail below) to meet the illumination needs of one or more specific applications. For example, the number of extended members, number of light emitting devices on each extended member, size and type of the hub, and/or number of light emitting devices on the hub can be chosen specific to each light fixture component and the electrical controls for custom functionality configured without having to generate a completely new design.

FIG. 1B shows a top view of light fixture 100's eight extended members, i.e., extended members 102A, 102B, 102C, 102D, 102E, 102F, 102G and 102H. Extended members 102A-102H are shown as converging together and joining hub 104. Each of extended members 102A-102H and/or hub 104 can be comprised of the same or different material(s). For example, one or more of extended members 102A-102H and/or hub 104 can be comprised of any type of metal, plastic, composite material, anything else that can support one or more light emitting devices and electrical components, or any combination thereof. In some embodiments, the material can be chosen based on the physical properties of the material in combination with the type of light emitting device(s) that may be used. For example, when light fixture 100 is designed to accommodate light emitting diodes, fixture 100 can be constructed with aluminum or any other material that may be thermally conductive to help facilitate the cooling of the light emitting diodes.

FIG. 1B also identifies with reference numerals the four light emitting devices 106 on hub 104 and three of the light emitting devices 106 on extended member 102F. Additional light emitting devices are included on the other extended members, but are not identified with a reference numeral to avoid overcomplicating the drawings. Light emitting devices 106 can be the same, different or a combination. For example, every light emitting device coupled to light fixture 100 can be a single color light emitting diode. As another example, some of the light emitting devices can be a halogen light bulb. As yet other example, every light emitting device can be an array of multi-color light emitting diodes, some can be incandescent light bulbs, and one can be a florescent light bulb. As another example, the light emitting devices integrated into hub 104 can be incandescent light bulbs, while the light emitting devices on the extended members 102A-102H are light emitting diodes. Each extended member, for example, can comprise different types of light emitting devices, its own type of light emitting devices, or a combination thereof.

Some light emitting devices (such as, e.g., multi-color light emitting diodes) can also include integrated control circuitry, a diffusion lens, and other components. The control circuitry, for example, can be configured to communicate with light fixture 100. Similarly, light fixture 100 can comprise a central processor or other electrical control component (discussed in greater detail in connection with, e.g. FIG. 4) configured to send control signals to one or more light emitting devices, thereby coordinating the functionality of each light emitting device. The control signals could be sent wirelessly or via any type of physical connection. The control signal can be relatively complex providing data using a communications protocol and/or relatively simple variable logic signal. In some embodiments, light fixture 100's electrical control component can regulate the electrical power supplied to one or more light emitting devices, thereby controlling, e.g., the illumination functionality of each light emitting device.

Any means can be used to physically and electrically couple each light emitting device to extended member 102A-102H and/or hub 104 of light fixture 100. For example, a light emitting device can be physically coupled to an extended member by welding, bolting, adhering, screwing, etc. Electrically coupling examples comprise wires, metal contacts, wireless induction, etc. In some embodiments, the surface or any other part(s) of one or more components of light fixture 100 can conduct electricity, thereby eliminating the need for at least some wires being integrated into light fixture 100.

Light fixture 100 can be designed to have any dimensions and, similarly, each component of light fixture 100 can be individually designed to have any dimensions to meet the variables of a specific lighting application. For example, a common highway lighting application may be satisfied with a lighting fixture having a length of 12 inches when measured from the distal (i.e., non-hub) end of extended member 102A to the distal end of extended member 102E. As another example, the width of one or more of extended members 102A-102H can be the same or different than another one of the extended members. For example, each extended member could have a width of 1.25 inches. The width and/or thickness of each extended member could also be a function of the overall length of each extended member, the total number of extended members being included in the light fixture's design, the material being used to construct the various component(s) of the light fixture, any other aspect of the design, or any combination thereof. For example, in embodiments having eight extended members made from aluminum, each six inches of length can suggest a quarter of an inch of thickness, thereby giving each extended member a relatively high surface area to volume ratio which is sometimes referred to herein as being "flat" (despite possibly having a tangible thickness).

In some embodiments, hub 104 can be a separate component onto which each extended member 102 is fastened. Hub 104 can also be flat in some embodiments, and/or as thick as the extended member(s). For example, when the total length of light fixture 104 from one end of extended member 102A to the distal end of extended member 102E is 12 inches, hub 104 can be an octagon having a width of 3 inches and thickness of a quarter-inch. The octagon's sides can be about 1.25 inches. Each extended member can be 4.5 inches long and also have a width of about 1.25 inches and a thickness of a quarter-inch. Extended members 102A-102H can be fastened to hub 104 by any physically coupling means, including welding, bolting, adhering, screwing, and/or anything else. Similarly, in some embodiments, hub 104 can be electrically coupled to one or more of extended members 102A-102H. In other embodiments hub 104 and/or each extended member can be configured to function in an electrically independent manner (by including, e.g., batteries and other electrical components, such as wires, into each functional component).

In some embodiments (not shown), hub 104 can be created by at least two extended members being overlapped and/or fastened together at one of their ends. For example, an end of each extended member can be physically fastened together by any means, thereby creating a hub where the extended members are overlapped and joined together.

A hub of some embodiments is formed from extended members being fastened together at their centers. For example, extended members 102A and 102E may be a single, long rectangular piece of sheet metal that is joined to extended members 102C and 102G, which is a second piece of sheet metal.

In some other embodiments, hub 104 and extended members 102A-102H can be created by cutting, or forming otherwise, at least part of the hub and at least some of the extended members from a single piece of metal and/or other material. One skilled in the art would appreciate that a combination of the embodiments discussed herein could also be used to create extended members 102A-102H and hub 104 of light fixture 100 without departing from the spirit of the invention. For example, extended members 102A, 102C, 102E, and 102G can be cut from a first piece of metal and extended members 102B, 102D, 102F and 102H can be cut from a second piece of metal, wherein both pieces of cut metal form an "x" shape. The first and second pieces of cut metal can then be fastened together at their centers, forming an eight-sided hub, similar to hub 104. Light emitting devices and any electrical components can then be coupled to hub 104 and/or any or all of extended members 102A-102H to form light fixture 100.

As shown in FIGS. 1C and 1D, extended members 102A-102H can be angled in relation to the plane of hub 104. As such, hub 104 can define "a reference plane." The angling of each extended member independent of the other extended members enables the general design of light fixture 100 to be configured to meet the multidimensional lighting requirements of varying applications. For example, as shown in FIG. 1C, each extended member can be positioned at a predefined angle, as represented by a, relative to the reference plane of hub 104. The angle relative to the reference plane can be measured in degrees, radians or by another scheme. For example, the value of a can be 25 degrees. This configuration can, among other things, enable light fixture 104 to provide uniform lighting over a wide area when mounted, e.g., above the ground facing down or on the ground facing up. In some embodiments, each extended member can be angled multiple times, some examples of which are discussed in greater detail below in connection with, e.g., FIGS. 3A-3C. Although relatively sharp angles are shown in the drawings, one skilled in the art would appreciate that more rounded angles could be used.

In addition to a mounting surface that has is a tangible structure (like hub 104), in some embodiments, the reference plane can be defined by an imaginary mounting surface that is an invisible, mass-less two-dimensional plane in space that is parallel or positioned otherwise relative to the surface of the ground below (including, e.g., a parking lot's surface, street surface, Earth's surface, surface of a body of water, vehicle surface, etc.) or ceiling above (including, e.g., an automobile ceiling, airplane cargo bay roof, home ceiling, parking garage ceiling, etc.). For example, in embodiments where there is no hub (not shown), the reference plane can be defined by the plane of the street below the light fixture. As another example, where the hub is angled and/or curved (not shown), the reference plane can be defined by the ceiling of an airplane's cargo bay.

When at least one extended member is angled relative to the plane of the hub, each of the two faces (i.e., the two sides that have the largest surface areas) of the hub and extended members can be referenced as either the concave face or convex face. The concave face is the interior face (relative to the angling direction of the extended member(s) nearest the hub), while the convex face is the exterior face of the extended members and hub (again, relative to the direction of the angling nearest the hub). For example, FIG. 1C shows the concave face of extended member 102G. As another example, FIGS. 1A-1D show light emitting devices 106 physically coupled to the convex face of each extended member 102A-102H and hub 104. In addition, light emitting devices are shown in FIGS. 1A-1D as being physically configured to shine in a direction generally orthogonal to the convex face of each extended member and hub. As such, light fixture 100 points light emitting devices 106 in different directions, thereby providing multidirectional, three-dimensional illumination.

In some embodiments (not shown), one or more of the extended members' a value can be different than at least one other extended member's a. For example, when designing a light fixture for installation above the ground in a corner area of a room or parking deck, the extended member closest to the corner can be parallel with the hub and the ground (i.e., have an a value equal to 0 degrees, thereby causing its light emitting devices to shine straight down, as opposed to onto the wall), while the extended member farthest from the corner can have an a value of, e.g., 25 degrees to shine light towards the ground farther away from the corner. Similarly, in some embodiments, the other six extended members' a value can vary between, e.g., 0 and 25 degrees based on the configuration of the room and particular illumination application (e.g., ceiling height, wall length, extended member length, lumens requirements, etc.), to maximize the amount of light provided to the floor area while minimizing the amount of light shining on the wall.

In some embodiments, one or more portions of light fixture 104, sometimes referred to herein as mounting components, can be configured to assist in mounting light fixture 104 to a ceiling, lamp post, or other support structure. For example, the end portions of one or more of extended members 102A-102H can be configured to include a mounting component, which can enable light fixture 104 to be physically coupled to a support structure. The example shown in FIGS. 1C and 1D includes flanges on each distal end portion of extended member 102A-102H, which can be created by angling a portion of the extended member β degrees at a location near the distal end of the extended member. For example, when the α value is 25 degrees, the β values can also be configured to be 25 degrees, so the plane of the flange is parallel with the plane of hub 104. In addition to or instead of angling the distal end portion of one or more extended members 102A-102H, one or more extended members can be configured to function as a mounting component by being configured to receive a fastening component, such as a bolt or screw.

Figure 2:
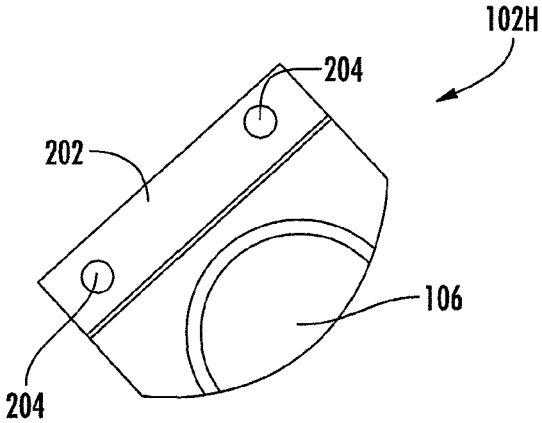
FIG. 2 shows a detailed view of a mounting component formed at the end of an extended member in accordance with some embodiments.

FIG. 2 shows an exemplary detailed view of mounting component 202, which is formed at the distal end portion of extended member 102H (see FIG. 1B). Mounting component 202 is shown as including two holes 204, which can be drilled or have formed in any other manner. For example, when extended member 102H is 1.28 inches wide (or thereabout), holes 204 can be located, e.g., 0.147 inches from the distal end edge of extended member 102H and 0.250 inches from the respective side edge of extended member 102H. Holes 204 can have any suitable diameter, such as, e.g., 0.160 inches, for receiving fastening components. One skilled in the art would appreciate that mounting component 202 can be any size, located anywhere, and comprise any type of mounting component, including, e.g., a magnet, adhesive, fastener (additional examples of which are discussed above), ball and/or joint, any other type of mounting component, or any combination thereof.

In some embodiments (not shown), hub 104 may be configured to have a mounting component in addition to or instead of one or more extended member mounting components. For example, a pole or other support member could be fastened (by welding, etc.) onto hub 104 by means of a hub mounting component. The support member could be, e.g., placed into the ground, fastened to an overhead area (such as a room's ceiling), or physically coupled to a vertical apparatus (such as a wall, building support beam, etc.). As such, hub-based mounting components and one or more light emitting devices can be located on the same and/or different sides of the hub (e.g., the downward facing side, the upward facing side, and/or the relatively narrow edge where the extended members protrude in FIGS. 1A-1D).

Electrical components, examples of which include wires and those discussed in connection with FIG. 4, can be installed in a support member (not shown), on/in the hub, and/or on/in one or more of the extended members. For example, a metal pipe could function as both a support member and an electrical wire conduit, while simultaneously protecting any circuitry from rain, wind, snow, dust, and/or other natural elements.

Solar panels or other sensors (discussed more in connection with FIG. 4) can also be physically and electrically coupled to light fixture 100. Solar panels and sensors can be used to, for example, generate electricity and/or detect the level of ambient light, thereby powering the light emitting devices 106 of light fixture 100 and/or triggering the activation of light emitting devices 106.

Although extended members 102A-102H are shown in FIGS. 1A-1D and FIG. 2 as being sharply angled at the hub and generally straight and flat with a flange as a mounting component at the end, some embodiments can include curved extended members and/or extended members that have one or more other types of rounded bends. The rounded bends of an extended member can be in any direction or combination of directions forming, for example, an "S" shape, twisted shape, "U" shape, or any other curved design that can also support and direct the illumination of a light emitting device. Such design features could enable a light fixture in accordance with embodiments of the invention to meet the variables associated with different applications and/or provide additional aesthetic benefits.

Figure 3A:
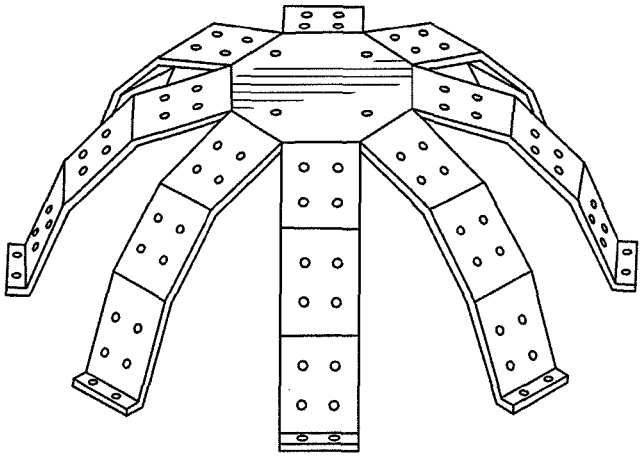
FIGS. 3A-3C show various views of a light fixture in condition with some embodiments configured to receive light emitting devices on either the concave and/or the convex faces of each extended member and the hub.
Figure 3B:
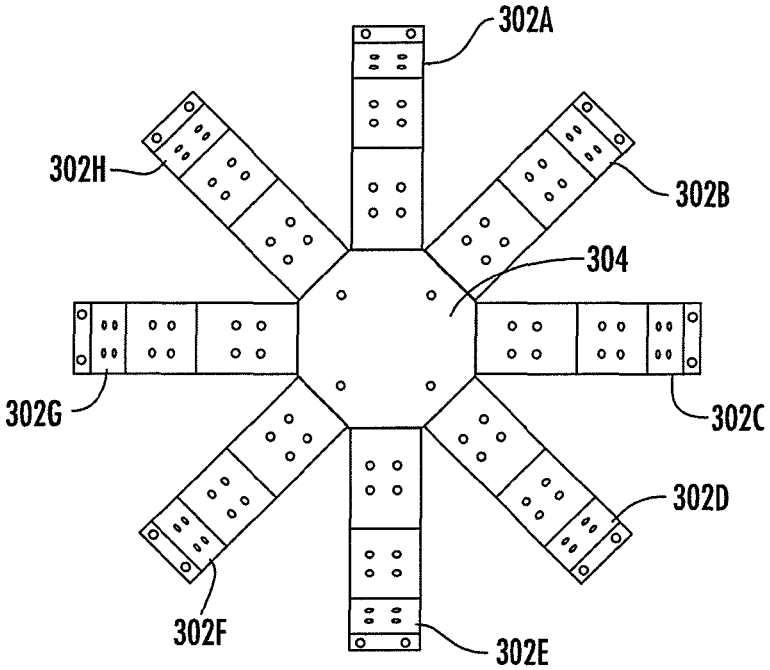
Figure 3C:
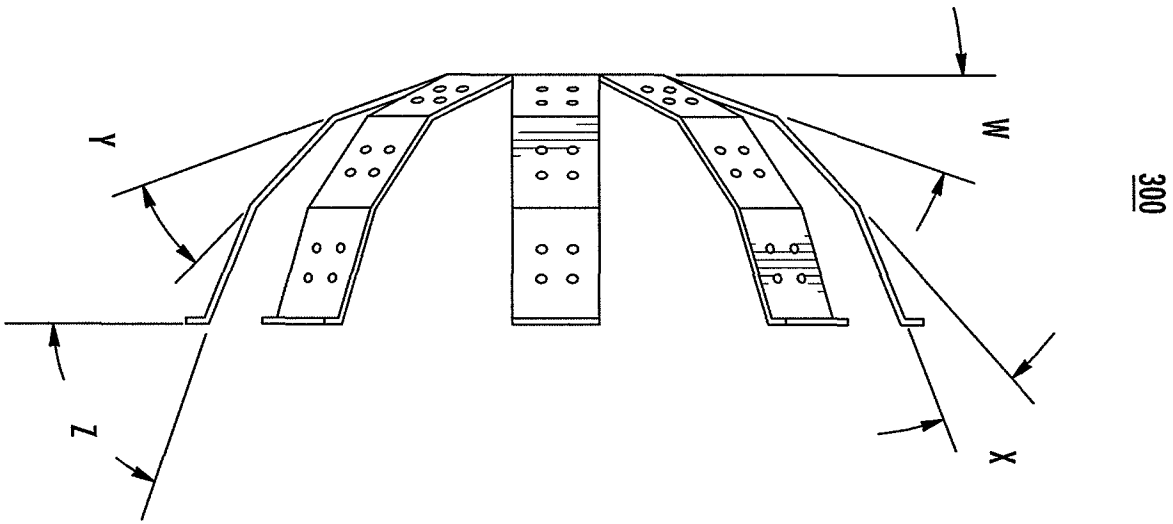

In addition to curves, FIGS. 3A-3C show a second exemplary light fixture 300 in accordance with some embodiments of the present invention. Light fixture 300 can function, in many respects, similar to or the same as light fixture 100 of FIGS. 1A-1D. Likewise, extended members 302A-302H and hub 304 can function and be comprised of materials that are similar to or the same as extended member 102A-102H and hub 104, respectively.

Although not shown in FIGS. 3A-3C, one or more light emitting devices can be physically and electrically coupled to the concave side, convex side, or both sides of one or more extended members 302A-302H and/or hub 304. All of extended members 302A-302H and hub 304 are shown in FIGS. 3A-3C as including holes that can be used to wire and or mount light emitting devices. One skilled in the art would appreciate that more, less, or no holes, can be included in each of extended members 302A-302H and/or hub 304 for physically and/or electrically coupling light emitting devices or providing other functionality.

Unlike light fixture 100, extended members 302A-302H of light fixture 300 are angled sharply in a plurality of locations. Although the designs of light fixtures 100 and 300 are both hub and spoke designs, the design of light fixture 300 may be better suited for some applications than light fixture 100's design. For example, the additional angling of each extended member 302A-302H may allow light fixture 300 to more efficiently illuminate a small, closed in area, such as airplane's cargo bay, subway train, automobile interior, among others. As another example, light fixture 300 may be more suitable to be worn on a user's head in a mine or other dark area.

FIG. 3C shows examples of angle values used to form each extended member 302A-302H. Some or all of angles W, X, Y and Z could be congruent. For example, angles W and X could be congruent (e.g., 20 degrees), while angles Y and Z are each different (e.g., 30 and 70 degrees, respectively). One skilled in the art would appreciate that the angles W, X, Y, and/or Z could be configured to be a suitable value and that additional angles, which may be rounded or sharp, could be incorporated into any or all of extended members 302A-302H.

Light fixture 300 is shown in the drawings as including a flange that can function similar to or the same as mounting component 202 of FIG. 2. Likewise, any other mounting component, some examples of which are discussed above, can be utilized in connection with light fixture 300.

It may be desirable to combine the aspects of the designs and/or functionality of light fixtures 100 and 300. For example, a light fixture could include extended members 102A-102D and extended members 302E-302H. One skilled in the art would appreciate that the extended members and hubs discussed in connection with FIGS. 1A-D and 3A-C are exemplary and a light fixture in accordance with embodiments discussed herein can comprise extended members having any shape, wherein each can be angled at any degree, each can include any number of light emitting devices (including any type of optical lens), each can be of any length, width and thickness, and each can be made of any suitable material.

FIG. 4 is a block diagram showing circuitry 400, which includes exemplary physical components of a light fixture (e.g., light fixture 100 or light fixture 300) in accordance with some embodiments. Reference will now be made to FIG. 4 in order to describe an example structure and functional operation of the electrical aspects of a light fixture according to a exemplary embodiments. In this regard, as shown in FIG. 4, the light fixture may include processor 402, memory 404, input 406, any number of outputs 408A-408N, and power source 410.

In exemplary embodiments, processor 402 may be configured (e.g., via execution of stored instructions or operation in accordance with programmed instructions, some examples of which are discussed in connection with FIG. 5) to communicate with and/or control the operation of other devices and/or components of the light fixture. Processor 402 may be embodied in a number of different ways. For example, processor 402 may be embodied as one or more of various processing means or devices such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. In some exemplary embodiments, processor 402 may be configured to execute instructions stored in a memory device (e.g., memory device 404) or otherwise accessible to processor 402. The instructions may be permanent (e.g., firmware) or modifiable (e.g., software) instructions. Alternatively or additionally, processor 402 may be configured to execute hard coded functionality. As such, whether configured by hardware or software methods, or by a combination thereof, processor 402 may represent an entity (e.g., physically embodied in circuitry) capable of performing operations according to embodiments of the present invention while configured accordingly. Thus, for example, when processor 402 is embodied as an ASIC, FPGA or the like, processor 402 may be specifically configured hardware for conducting the operations described herein. Alternatively, as another example, when processor 402 is embodied as an executor of software or firmware instructions, the instructions may specifically configure processor 402 to perform the algorithms and/or operations described herein when the instructions are executed. Processor 402 may include, among other things, a clock, an arithmetic logic unit (ALU) and logic gates configured to support operations of the light fixture. Additionally, as used herein, the term "circuitry" refers to not only hardware-only circuit implementations including analog and/or digital circuitry, but at least also to combinations of circuits with corresponding software and/or instructions stored on a computer-readable storage medium.

Memory 404 can be a "computer-readable storage medium," which is defined herein as referring to a physical storage medium (e.g., volatile or non-volatile memory device), and can be differentiated from a "computer-readable transmission medium," which refers to an electromagnetic signal. Memory 404 can be used to, e.g., store configuration data in addition to or instead of any other data. Only one or a number of computer-readable storage media can be represented by memory 404 of FIG. 4. As such, memory 404 may include, for example, one or more volatile and/or non-volatile memories. In other words, for example, memory 404 may be an electronic storage device (e.g., a computer-readable storage medium) comprising gates configured to store data (e.g., bits) that may be retrievable by a machine (e.g., a computing device including a processor such as processor 402). Memory 404 may be configured to store information, data, applications, instructions or the like for enabling the light fixture to carry out various functions in accordance with exemplary embodiments of the present invention. For example, memory 404 could be configured to buffer input data for processing by processor 402. Additionally or alternatively, memory 404 could be configured to store instructions for execution by processor 402.

Via configuration information stored in memory 404, input 406 may be configured to interface with any number of external devices such as, one or more sensors (e.g., ambient light detectors, thermometers, etc.), communications hardware (e.g., USB hardware, Ethernet hardware, RS232 hardware), wireless networks, input devices (e.g., keyboards, computer mice, touch interfaces, etc.), any other external device or component, or any combination thereof. As such, input 406 may be configured to support one or more roles that the light fixture may be configured to perform. For example, an ambient light sensor can be configured to determine whether the ambient light is below a threshold value and, in response, send a corresponding signal to processor 402. Processor 402 can then cause one or more of the light emitting devices of the light fixture to be illuminated. As another example, input 406 can be used to receive configuration data that may allow the light fixture to illuminate in various colors, flash particular lights in various patterns, and/or provide any other functionality.

Processor 402 can be configured to use one or more of outputs 408A-408N to communicate with and/or control light emitting devices on one or more extended members (such as, e.g., those discussed in connection with FIGS. 1A-1D and/or FIGS. 3A-3C), any other component of a light fixture, a remote server (not shown), another light fixture's processor (similar to or the same as processor 402), or any combination thereof. In some embodiments, outputs 408A-408N are dedicated ports (or pins) that are hardwired to one or more light emitting devices. For example, each extended member of the light fixture can have its own dedicated output (e.g., extended member 102A can be configured to receive signals from output 408A, etc.). Processor 402 can communicate with and/or control other components and devices using a simple logic 1 or 0 and/or via more complex operations in accordance with corresponding instructions stored in memory 404. For example, in response to processor 402 instructing output 408A to send and/or maintain a logic 1 signal, some or all the light emitting devices on extended member 102A can be switched ON independent of the other extended member's functionality.

Power source 410 can be any suitable source of electrical power. For example, power source 410 can comprise one or more solar panels, mains power supply, batteries, any other component or apparatus, or any combination thereof.

In some embodiments, the components shown in FIG. 4 can receive power and/or communicate via bus 412. Bus 412 can also be used to route power to other light fixture components, such as light emitting devices. Additionally, wired or wireless communication interfaces may be implemented to communicate with other components of the light fixture or other apparatus.

Having thus described the physical components, apparatuses and systems of embodiments of light fixtures by way of example, a process flow according embodiments for designing a light fixture are discussed in connection with FIGS. 5A and 5B. In this regard, FIGS. 5A and 5B show process 500, which represents a method and program product according to some example embodiments discussed herein. It will be understood that each block of the flowchart, and combinations of blocks in the flowchart, can be implemented by various means, such as hardware, firmware, and/or computer program product including one or more computer program instructions. As will be appreciated, any such computer program instructions may be loaded onto a computer or other programmable apparatus (i.e., hardware) to produce a machine, such that the instructions which execute on the computer or other programmable apparatus create means for implementing the functions specified in the flowchart block(s). These computer program instructions may also be stored in a computer-readable memory that can direct a computer or other programmable apparatus to function in a particular manner, such that the instructions stored in the computer-readable memory produce an article of manufacture including instruction means which implement the function specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus provide steps for implementing the functions specified in the flowchart block(s). Similarly, the output of the culmination of the functions specified in the flowchart can be used to create computer program instructions that can be loaded onto a light fixture's memory (e.g., memory 404) and produce a machine, such that the instructions which can be executed on the computer or other programmable apparatus (e.g., processor 402) can cause control and direct the light fixture's components (e.g., light emitting devices located on one or more extended members and/or the hub).

Accordingly, blocks of the flowchart support combinations of means for performing the specified functions, combinations of operations for performing the specified functions and program instruction means for performing the specified functions. It will also be understood that one or more blocks of the flowchart, and combinations of blocks in the flowchart, can be implemented by special purpose hardware-based computer systems which perform the specified functions or combinations of special purpose hardware and computer instructions.

Flowchart 500 starts at block 502 and proceeds to block 504, where input data is received by the light fixture design and configuration machine. The input data can represent one or more illumination requirements and/or variables that represent a lighting application, examples of which are discussed in greater detail above. For example, the light fixture design and configuration machine can receive data identifying the size of the area to be illuminated, the lumens requirements, triggering conditions (e.g., timed or pulsed illumination, dimming capability, low ambient light activation, etc.), environmental conditions (e.g., ability to withstand natural elements, etc.), among others. Additionally, the input data can indicate to the light fixture design and configuration machine whether the light fixture is intended to be bottom mounted (using, e.g., a pole in the ground as a support member), top mounted (e.g., hung from the ceiling), or side mounted (e.g., affixed to a wall). The intended mounting of the light fixture may be a variable in determining, e.g., the quality of lights, whether lights should be placed on the concave and/or convex faces, etc.

In response to receiving the illumination requirement and variable input data, a determination is made at block 506 as to whether the user would like to identify one or more preferred types of light emitting devices for the light fixture's design. For example, a user may want to design a light fixture that is configured to utilize light emitting diodes, incandescent bulbs, florescent light bulbs, any other type of light emitting device, or any combination thereof. Each type of light emitting device has advantages and disadvantages associated with it, including, e.g., power usage requirements, potential brightness, life span, resiliency (to, e.g., shock, natural elements, extreme temperatures, etc.), replacement and maintenance procedures, energy efficiency, and upfront material cost among others.

Block 508 follows block 506 in response to determining that a user would like to indicate a preference for a particular type or types of light emitting devices. At step 508, input data is received, which identifies the desired type(s) of light emitting device(s).

Block 510 follows block 506 in response to determining that the user does not have a preference for the type(s) of light emitting device(s) used in the light fixture. The determination at block 506 can be made based on, e.g., a user input, the particular variables and/or requirements (e.g., only one light emitting device may be suitable for a particular application), etc. At block 506, the system can automatically determine which type(s) of light emitting devices should be accommodated by the light fixture being designed.

Next is block 512, at which a determination is made as to whether there is a maximum size requirement for the light fixture. For example, a light fixture intended for use in a tunnel or parking deck may have to be smaller than one foot across and less than 6 inches high (as measured from the distal end of an angled extended member to the hub or top of the light fixture). Such size limitations can directly limit the length, width and/or thickness of each component of the light fixture (e.g., extended member(s), hub, etc.). Additionally, the size limitations can indirectly impact the angles of the light fixture. For example, a light fixture may need to occupy no more than one cubic yard of space, but also require at least ten 2-inch diameter lights on each of four extended members. As such, each extended member would have to be at least twenty inches long. Therefore, the size requirement of block 512, in conjunction with the lighting device requirement of block 506 may indirectly create an angle requirement that process 500 would compensate for when producing an output. In some embodiments, one or more blocks can be integrated into process 500 that allow the user to directly enter angle requirements for one or more extended members. Similarly, one or more blocks could be added to process 500 to integrate any of the light fixture or other features discussed herein.

As a contrary example, a light fixture intended for an outdoor parking lot may not have any size restrictions received at block 514. In response to determining that there is a maximum size requirement for the light fixture, input data can be received at block 514, which identifies the maximum size of the light fixture.

Flowchart 500 then proceeds to FIG. 5B. At block 516 a determination is made as to whether there is a maximum weight requirement for the light fixture. For example, a light fixture being hung from the ceiling of an airplane's cargo bay and/or intended to for hand-held use may have to weigh less than a maximum weight value. However, as a contrary example, a light fixture being installed on the ground for the purpose of illuminating a sign or building may not have any weight restrictions. In response to determining that there is a maximum weight requirement for the light fixture, input data can be received at block 518, which identifies the maximum weight requirement of the light fixture.

At block 520, one or more light fixture design options are generated, which meet the requirements, variables and other input data, while also providing multidirectional illumination using at least two extended members and a hub. At block 522, the design option(s) are displayed using a display screen to the user. In some embodiments, the cost(s) and/or benefit(s) can be displayed with each design option. The costs and benefits can help the user decide which design option is best for one or more given applications. For example, some designs may be more costly than others, but offer other advantages, such as, e.g., requiring fewer light fixtures to be needed to meet the needs of a particular application, providing enhanced durability, operating for a longer life span, being more energy efficient and saving money over time, etc.

Input data is received at block 524, which identifies the chosen design option and at block 526 the system generates configuration data that can be installed on the light fixture's electrical components. The configuration data can include instructions and other machine-readable code (some examples of which are discussed above) that may enable the light fixture to function in accordance with the variables and illumination requirements entered throughout the process shown in flowchart 500. For example, configuration data can be created that causes each extended member of the light fixture to receive power based on the relative amount of ambient light detected by the given extended member's light sensor. The configuration data can be uploaded and stored on, for example, the memory (404) of the light fixture.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A light fixture configured to provide multidirectional illumination, comprising:

a hub defining a reference plane;

extended members each having a distal end, wherein:

each of the extended members is physically coupled to the hub, and at least one of the extended members is positioned at a first non-zero predefined angle relative to the reference plane;

light emitting devices, wherein:

at least one of the light emitting devices is physically and electrically coupled to one of the extended members, and the light fixture points at least two of the light emitting devices in different directions; and a mounting component comprising a flange disposed at the distal end of each of a plurality of the extended members, wherein the flange defines at least one hole and is configured for mounting the light fixture to a substantially planar surface.

2. The light fixture of claim 1, wherein a second of the extended members is angled, relative to the reference plane defined by the hub, at a different angle than the first predefined angle, and wherein the angling of the second of the extended members is defined proximate that point at which the second of the extended members is physically coupled to the hub.

3. The light fixture of claim 1, wherein the light emitting devices comprise light emitting diodes.

4. The light fixture of claim 1, wherein:

the hub has an octagon shape; and the extended members consist of eight extended members that are physically connected to each of the hub's eight sides.

5. The light fixture of claim 1, wherein a plurality of the light emitting devices are physically and electrically coupled to each of the extended members.

6. The light fixture of claim 5, wherein the plurality of the light emitting devices are physically and electrically coupled to a convex face of each of the extended members.

7. The light fixture of claim 5, wherein the plurality of the light emitting devices are physically and electrically coupled to a concave face of each of the extended members.

8. The light fixture of claim 1, further comprising a plurality of the light emitting devices physically and electrically coupled to the hub.

9. The light fixture of claim 1, wherein the at least one of the extended members comprises a portion proximate a distal end of the respective extended member that is oriented at an angle different than the first predefined angle with respect to the reference plane.

10. The light fixture of claim 1, wherein extended members are comprised of a thermally conductive material.

11. The light fixture of claim 1, wherein the hub is configured to support a plurality of light emitting devices.

12. The light fixture of claim 11, wherein the hub is configured to support four light emitting devices.

13. The light fixture of claim 1, wherein each extended member is configured to support a plurality of light emitting devices.

14. The light fixture of claim 13, wherein each extended member is configured to support three light emitting devices.

15. A method of providing multidirectional illumination, comprising:

providing a hub defining a reference plane;

providing extended members coupled to the hub;

providing light emitting devices coupled to the extended members;

providing power to the light emitting devices that are physically and electrically coupled to the extended members;

in response to receiving the power, emitting light using at least one of the light emitting devices, wherein the emitting comprises:

emitting light outward from one of the extended members; and emitting light from the at least one of the light emitting devices that is mounted on the one of the extended members between a first location, defined by where the one of the extended members is physically coupled to the hub, and a second location, defined by a distal end of the one of the extended members; and mounting the light fixture to a substantially planar surface using a mounting component comprising a flange disposed at the distal end of each of a plurality of the extended members, wherein the flange defines at least one hole.

16. The method of claim 15 further comprising:

determining the quantity of ambient light local to the at least one of the extended members; and adjusting the power to control the brightness of the light emitting devices physically coupled to the one of the extended members.

17. The method of claim 15 further comprising:

receiving inputs associated with a lighting application; and illuminating at least some of the light emitting devices based on the inputs.

* * * * *